US008579715B2

(12) United States Patent
Olive et al.

(10) Patent No.: US 8,579,715 B2
(45) Date of Patent: Nov. 12, 2013

(54) AMUSEMENT SLIDE ELEMENTS AND SYSTEMS

(75) Inventors: Philip John Olive, East Sussex (GB); David John Cuttell, East Sussex (GB)

(73) Assignee: Splashtacular, Inc., Paola, KS (US)

( * ) Notice: Subject to any disclaimer, the term of this patent is extended or adjusted under 35 U.S.C. 154(b) by 245 days.

(21) Appl. No.: 13/080,452

(22) Filed: Apr. 5, 2011

(65) Prior Publication Data

US 2011/0183768 A1 Jul. 28, 2011

Related U.S. Application Data

(63) Continuation-in-part of application No. PCT/GB2009/002286, filed on Sep. 25, 2009.

(60) Provisional application No. 61/390,051, filed on Oct. 5, 2010.

(30) Foreign Application Priority Data

Oct. 8, 2009 (GB) ..... 0818483.0

(51) Int. Cl.
*A63G 21/18* (2006.01)
*A63G 21/00* (2006.01)

(52) U.S. Cl.
USPC ..... 472/117; 472/116

(58) Field of Classification Search
USPC ..... 472/13, 116, 117, 128, 129; 104/69, 70, 104/73
See application file for complete search history.

(56) References Cited

U.S. PATENT DOCUMENTS

| | | | | | |
|---|---|---|---|---|---|
| 4,198,043 | A | * | 4/1980 | Timbes et al. | 472/117 |
| 5,167,321 | A | * | 12/1992 | Brodrick, Sr. | 198/867.14 |
| 5,401,117 | A | | 3/1995 | Lochtefeld | |
| 5,433,671 | A | * | 7/1995 | Davis | 472/117 |
| 5,704,294 | A | * | 1/1998 | Van Winkle et al. | 104/73 |
| 6,354,955 | B1 | | 3/2002 | Stuart et al. | |

(Continued)

FOREIGN PATENT DOCUMENTS

| | | | |
|---|---|---|---|
| AU | 513147 | B3 | 6/1981 |
| GB | 2224948 | A | 5/1990 |
| WO | 2010040978 | A1 | 9/2009 |

OTHER PUBLICATIONS

International Search Report issued in Related PCT Patent Application PCT/GB2009/002286 dated Jan. 11, 2010, 4 pages.

(Continued)

*Primary Examiner* — Kien Nguyen
(74) *Attorney, Agent, or Firm* — Hovey Williams LLP

(57) ABSTRACT

Leisure and amusement slide elements and systems are disclosed. In one embodiment, a waterslide includes a bowl having a curved sidewall, two or more rider entrances for enabling riders to slide into the bowl and to circuit at least a portion of the bowl, and a receptacle for forming a pool of water to receive a rider exiting the bowl. A nozzle is provided for directing a jet of water to bias a rider towards an edge of the pool. Another slide apparatus includes a bowl having upper and lower ends and first and second entrances distinct from one another and spaced apart from the bowl lower end. The first and second entrances are configured to bias all users of the first and second entrances to travel about at least a portion of the bowl in a common direction, whether clockwise or counter-clockwise.

21 Claims, 13 Drawing Sheets

(56) References Cited

U.S. PATENT DOCUMENTS

| | | | | |
|---|---|---|---|---|
| 6,485,372 | B2 | 11/2002 | Stuart et al. | |
| 6,527,646 | B1 * | 3/2003 | Briggs | 472/117 |
| 7,371,182 | B2 * | 5/2008 | Henry et al. | 472/117 |
| 7,731,595 | B2 * | 6/2010 | Hlynka | 472/117 |
| 2005/0075180 | A1 | 4/2005 | Dubeta | |
| 2006/0194638 | A1 | 8/2006 | Hunter | |
| 2009/0062025 | A1 | 3/2009 | Hlynka | |
| 2009/0221377 | A1 | 9/2009 | Hlynka | |

OTHER PUBLICATIONS

International Search Report and Written Opinion issued in related PCT Patent Application Serial No. PCT/US2011/054948, dated May 7, 2012, 8 pages.

* cited by examiner

AMUSEMENT SLIDE ELEMENTS AND SYSTEMS

RELATED APPLICATIONS

This application is a continuation-in-part claiming priority to PCT/GB2009/002286 filed Sep. 25, 2009, which claims priority to GB 0818483.0 filed Oct. 8, 2008. This application also claims priority to U.S. Provisional Patent Application Ser. No. 61/390,051, filed Oct. 5, 2010. The disclosure of each is incorporated herein by reference.

BACKGROUND

The current invention relates to leisure and amusement slide elements and systems.

GB 2224948 discloses a leisure slide comprising a circular bowl having an exit aperture formed in its base. A rider travels down a tubular slide and circuits at least partway around the bowl before exiting the bowl through the exit aperture. The rider may slide with the aid of flowing water or a waxed plastic bag. In those arrangements in which the slide is a waterslide, the rider drops into a splash pool provided below the bowl.

U.S. Pat. Nos. 6,354,955 and 6,485,372 disclose a waterslide bowl element having a bottom wall configured to form a throat around a rider exit opening in the bottom of the bowl. The bowl holds an annular ring of water around the throat that slows down and conducts the rider to the exit opening. The waterslide bowl may be used by riders on inner tubes.

The known leisure rides of this type have a limited throughput, as there must be sufficient interval between riders to ensure that consecutive riders do not collide with each other. Typically, a rider should have exited the bowl before the next rider begins their ride. This is undesirable for individuals wanting to ride the slides, as they may have to queue to ride the slide. Equally, it is undesirable for the operator, as they may need to provide additional waterslides to cope with demand.

At least some of the problems associated with known prior art leisure rides may be overcome by the disclosed elements and systems.

SUMMARY

Leisure and amusement slide elements and systems are disclosed. In one embodiment, a waterslide apparatus includes a bowl having a curved sidewall, two or more rider entrances for enabling riders to slide into the bowl and to circuit at least a portion of the bowl, and a receptacle for forming a pool of water to receive a rider exiting the bowl. A nozzle is provided for directing a jet of water to bias a rider towards an edge of the pool.

In another embodiment, a waterslide apparatus includes a bowl, at least one chute for introducing a rider into the bowl, and a receptacle for forming a pool of water to receive a rider exiting the bowl. A nozzle is provided for providing a jet of water to bias a rider towards an edge of the pool.

In still another embodiment, a slide apparatus includes a bowl having upper and lower ends and first and second entrances. The first and second entrances are distinct from one another and are spaced apart from the bowl lower end. The first and second entrances are configured to bias all users of the first and second entrances to travel about at least a portion of the bowl in a common direction, whether clockwise or counter-clockwise.

In yet another embodiment, an exit system is provided for use with a leisure slide having a bowl. The exit system includes first and second exit slides and a housing configured to be positioned at a lower end of the bowl. The housing has a first exit port leading to the first exit slide and a second exit port leading to the second exit slide. The first and second exit ports are spaced apart from one another such that one user may pass through the first exit port generally simultaneously with another user passing through the second exit port.

DETAILED DESCRIPTION

Figure 1:
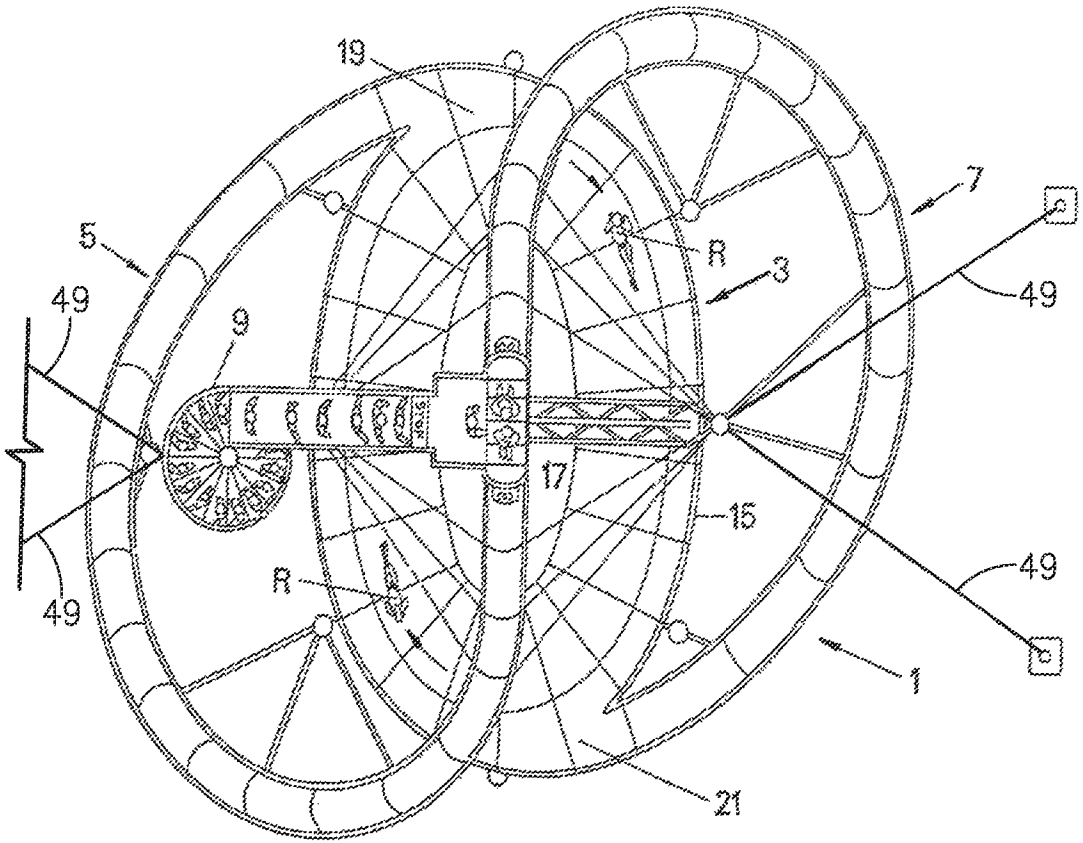
FIG. 1 shows a plan view of a waterslide in accordance with one embodiment of the present invention.

A plan view of a waterslide 1 in accordance with a first embodiment of the present invention is shown in FIG. 1. The waterslide 1 comprises a bowl 3, first and second chutes 5, 7 and a spiral staircase 9. The waterslide 1 may be used, for example, in a leisure or amusement park.

The bowl 3 has a generally oval plan form and is approximately 13.5 meters long and approximately 9.5 meters wide. While various dimensions are described herein, those skilled in the art will appreciate that other dimensions may also be appropriate. The bowl 3 has a sidewall 11 formed from a series of moldings supported on a metal framework 13. A rim 15 is provided around an upper edge of the bowl 3, and an aperture 17 is formed in the center of the bottom of the bowl 3. The rim 15 curves inwardly, and a middle region of the sidewall 11 below the rim 15 is substantially vertical. The lower region of the sidewall 11 slopes downwardly towards the aperture 17.

A first rider entrance 19 is provided at a first end of the bowl 3, and a second rider entrance 21 is provided at a second end thereof. The first and second rider entrances 19, 21 are provided proximal the upper edge of the bowl 3 and are arranged generally tangential to its circumference. The first and second chutes 5, 7 are connected to the first and second rider entrances 19, 21 such that riders R, R' may slide down the chutes 5, 7 and enter the bowl 3. The momentum of the riders R, R' allows them to travel at least partway around the bowl 3 before exiting through the aperture 17.

Figure 2:
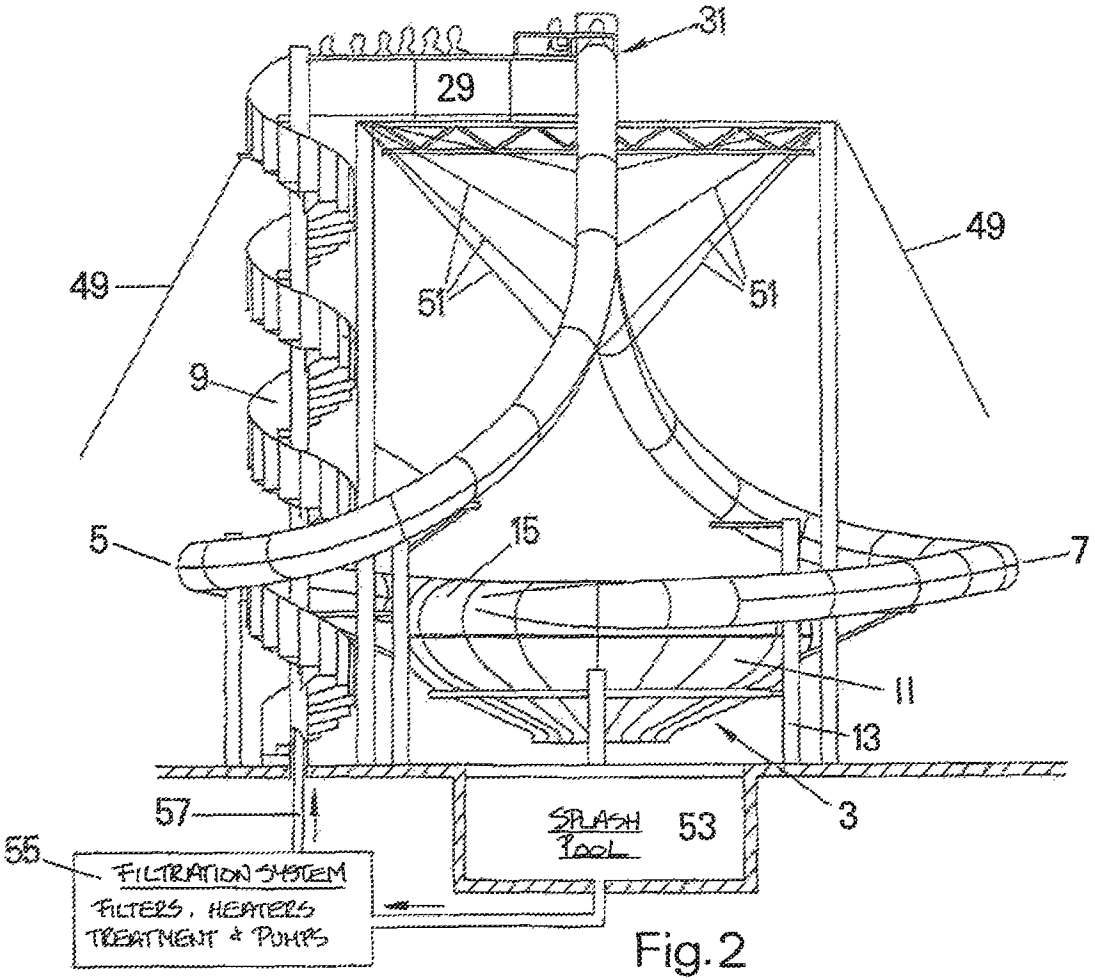
FIG. 2 shows a first side elevation of the waterslide of FIG. 1.
Figure 3:
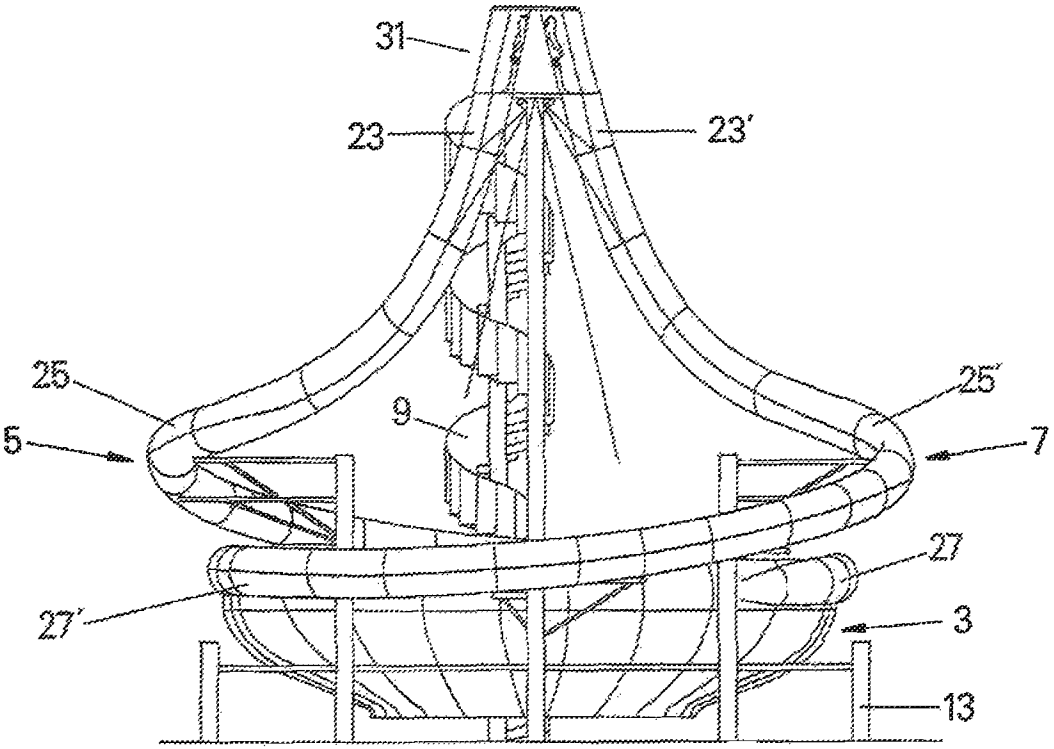
FIG. 3 shows a second side elevation of the waterslide of FIG. 1.

It may be desirable for the first and second chutes 5, 7 to be substantially the same as each other. As shown in FIGS. 2 and 3, the first and second chutes 5, 7 comprise upper sections 23, 23', mid-sections 25, 25' and lower sections 27, 27'. The upper sections 23, 23' are positioned above the center of the bowl 3 and are inclined at approximately 15° to the vertical. The mid-sections 25, 25' and the lower sections 27, 27' in plan form curve through approximately 270° to guide the riders R, R' to the rider entrances 19, 21. The lower sections 27, 27' are arranged substantially horizontally such that the riders R, R' enter the bowl 3 travelling substantially parallel to the rim 15. The term chute is used herein to refer to slides, flumes, and the like.

Figure 4:
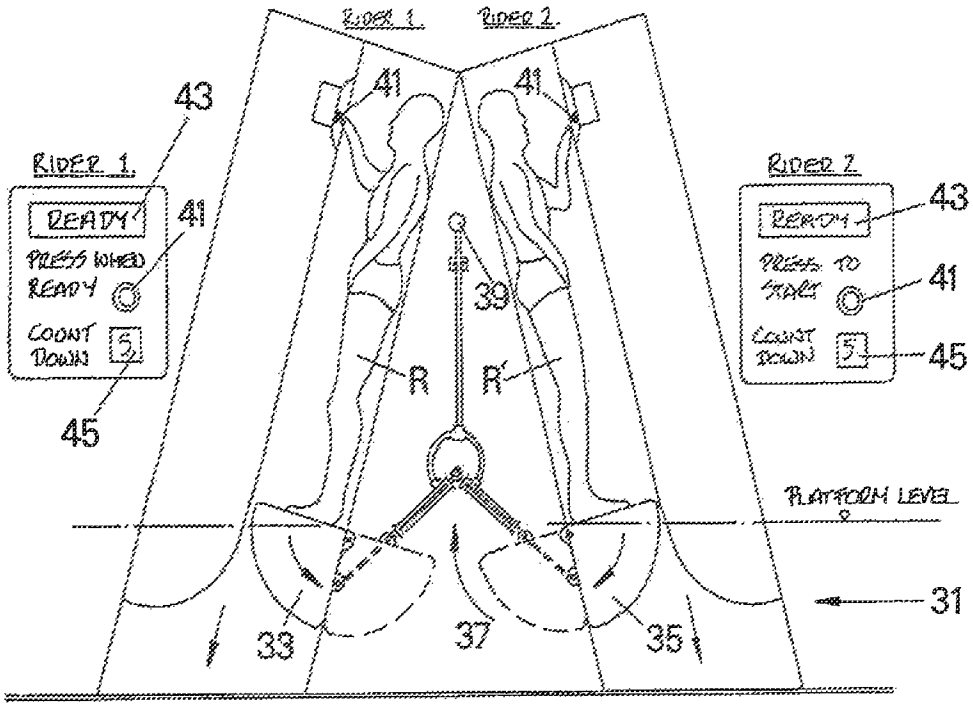
FIG. 4 shows a schematic representation of a launch mechanism for the waterslide of FIG. 1.

The staircase 9 leads to a gantry 29 where a launch station 31 is located. As shown in FIG. 4, the launch station 31 comprises first and second pivotally mounted platforms 33, 35. A pair of riders R, R' enters the launch station 31 from the side and each stand on their respective platforms 33, 35. A launch mechanism 37 is provided for pivoting the platforms 33, 35 between an extended position and a retracted position (shown in dashed lines in FIG. 4). The launch mechanism 37 is configured to ensure that the platforms 33, 35 pivot to their retract positions generally simultaneously, thereby ensuring that the riders R, R' are launched together.

The launch mechanism in the embodiment of FIG. 4 comprises a lever 39 to be actuated manually, for example by an operator; but the mechanism 37 could be automated. The launch station 31 may be provided with means to allow the riders R, R' to confirm that they are ready to be released. For example, the riders R, R' may be required to each press a respective button 41, and once both buttons 41 have been pressed, the message "READY" may be displayed on screens 43, and countdown timers 45 may activate.

The framework 13 supports the bowl 3 and the staircase 9 and may, for example, be of conventional construction. The gantry 29 is mounted on a pair of vertical columns. To provide additional support for the gantry 29, a first set of tethered cables 49 may be provided. A second set of cables 51 may additionally (or alternately) extend from the gantry 29 to support the upper sections 23, 23' and the mid-sections 25, 25' of the chutes 5, 7.

A splash pool 53 (FIG. 2) may be provided below the bowl 3 so that the riders R, R' exit the bowl 3 through the aperture 17 and fall into the pool 53. A filtration system 55 may be provided to treat the water in the pool 53 and may be provided with a pump (not shown) to pump the water to the top of the chutes 5, 7 via a pipe 57. In use, water may be continuously introduced into the top of the chutes 5, 7 so that there is a steady stream of water down the chutes 5, 6. Water may also be pumped to a perforated conduit extending around the rim 15 to wet the interior surface of the bowl 3 to reduce friction. Or, rather than provide a stream of water over the chutes 5, 7 and/or the interior of the bowl 3, a water spray may be provided to provide lubrication. A heater may be provided in the filtration system 55 to heat the water.

The operation of the waterslide 1 will now be described with reference to FIGS. 1 to 4. The riders R, R' climb the staircase 9 to the gantry 29 and enter the launch station 31 in pairs. A rider R, R' stands on each of platform 33, 35 in the launch station 31 and respectively press the buttons 41 to confirm that they are ready to be launched. Once both riders R, R' have confirmed that they are ready, the countdown timer 45 begins. When the countdown timer 45 reaches zero, the operator pulls the lever 39 to operate the launch mechanism 37, and the platforms 33, 35 pivot to their retracted positions. The riders R, R' then drop at generally the same time into the upper sections 23, 23' of the respective first and second chutes 5, 7 and accelerate as they slide towards the bowl 3.

The riders R, R' travel down the chutes 5, 7 and both enter the bowl 3 at substantially the same time. The riders R, R' are travelling substantially horizontally when they exit the lower sections 27, 27' of the chutes 5, 7 and enter the bowl 3 through the first and second rider entrances 19, 21 respectively. The rider entrances 19, 21 are located near the rim 15 of the bowl 3 and the momentum of the riders R, R' allows them to travel at least partway around the bowl 3.

The riders R, R' are unlikely to collide with each other as they travel around the bowl 3. If a first rider R is travelling quicker than a second rider R', then the quicker first rider R will be higher up the sidewall of the bowl 3 than the slower second rider T. Thus, if the first rider R is travelling sufficiently quickly to catch up with the second rider R', the riders R, R' will be at different heights.

The riders R, R' slow down due to frictional forces, and the reduced centripetal forces cause them to travel towards the bottom of the bowl 3. The riders R, R' may come to rest at the bottom of the bowl 3, or they may slide directly through the aperture 17 and enter the pool 53. The riders R, R' may then exit the waterslide 1 at the side of the pool 53. To reduce the likelihood of the riders R, R' colliding with each other as they enter the pool 53, a divider or partition (not shown) may be provided in the middle of the aperture 17. The likelihood of the riders R, R' colliding with each other is reduced since the divider or partition keeps them apart if they enter the pool 53 from opposite sides of the aperture 17. Instead of (or in addition to) the divider or partition, a jet of water may be provided in the pool 53 to move the riders R, R' away from the area below the aperture 17 once they are in the water. It may be desirable for the jet of water to be provided in the middle of the pool 53 and directed upwardly, thereby causing the water at the top of the pool 53 to move out towards the edges of the pool 53. The jet of water will thereby move the riders R, R' towards the sides of the pool 53.

Figure 5:
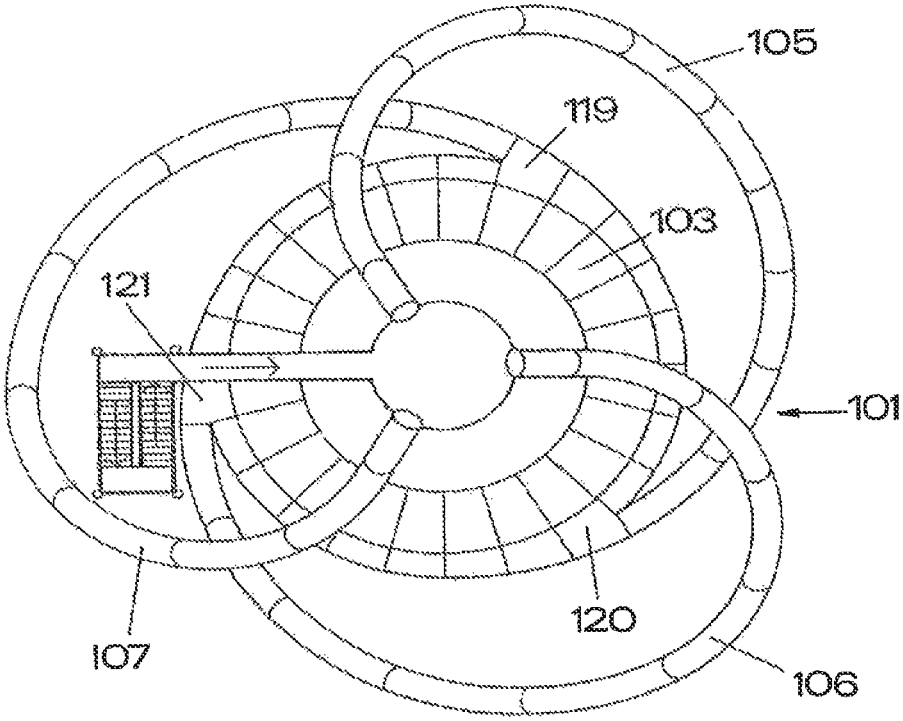
FIG. 5 shows a plan view of a waterslide in accordance with another embodiment of the present invention.
Figure 6:
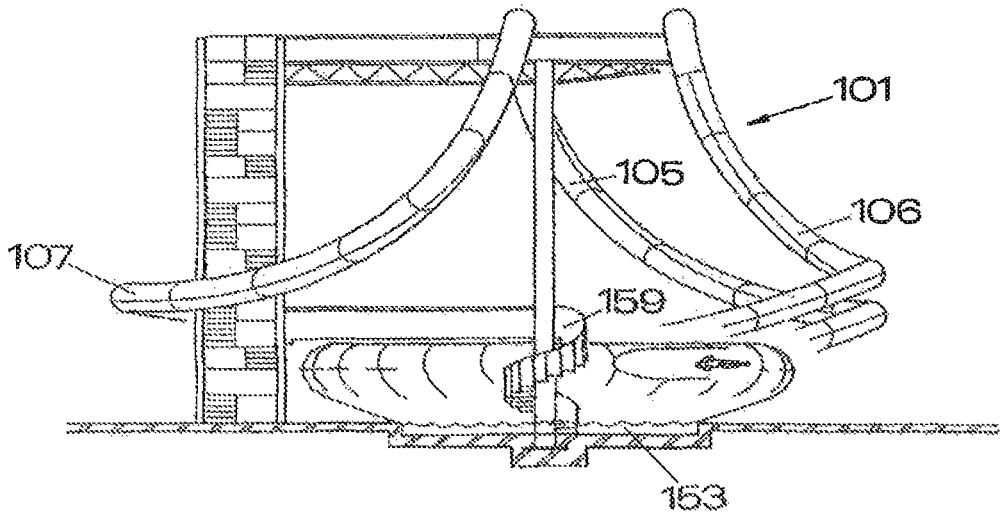
FIG. 6 shows a side elevation of the waterslide of FIG. 5.
Figure 7:
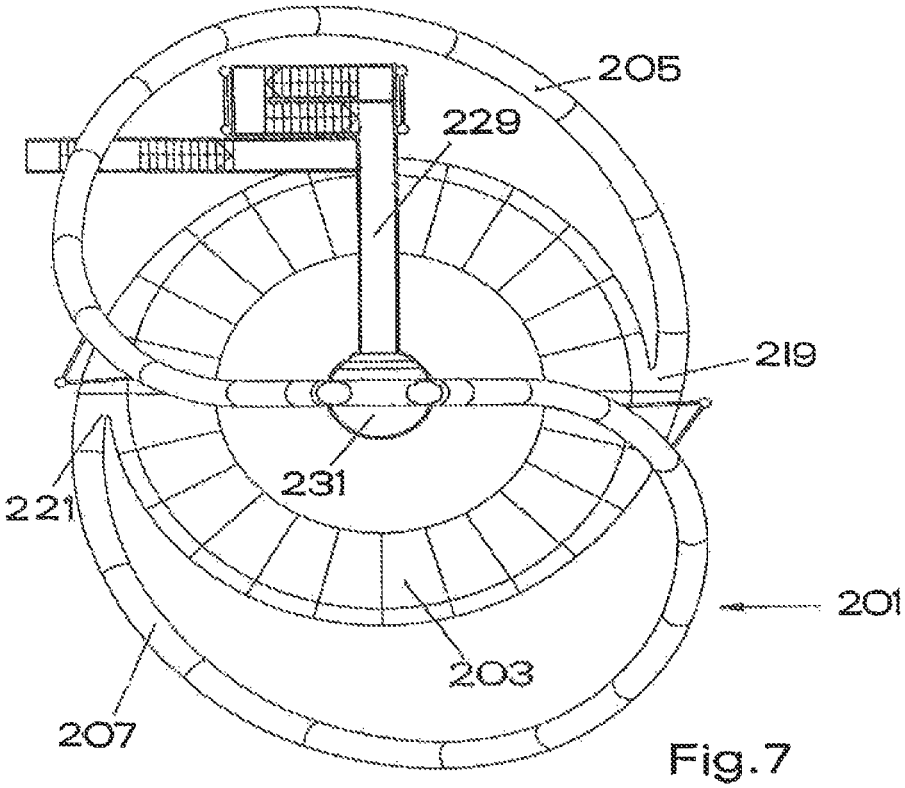
FIG. 7 shows a plan view of a waterslide in accordance with yet another embodiment of the present invention.

A waterslide 101 according to another embodiment of the present invention is shown in FIGS. 5 and 6. The waterslide 101 corresponds in many ways to the waterslide 1 shown in FIG. 14, and like reference numerals have been used for like components, albeit incremented by 100 for clarity.

The waterslide 101 comprises a bowl 103 into which riders are introduced. The bowl 103 is shown to be circular rather than oval, and the waterslide 101 comprises three chutes 105, 106, 107 down which three riders travel simultaneously. The riders enter the bowl 3 through three rider entrances 119, 120, 121 equally spaced around the circumference of the bowl 103 (i.e. spaced apart from each other by approximately) 120°). The launch station (not shown) may be modified from the launch station 31 to launch the three riders into the respective chutes 105, 106, 107 at substantially the same time.

A further distinction between embodiments 1, 101 is that the bowl 103 is not provided with an aperture 17 in its base. Rather, a shallow pool 153 is formed in the base of the bowl 3 and the riders drop directly into the pool 153. This arrangement may be desirable since the pool 153 does not have to be as deep as the pool 53. Thus, an individual who is not a confident swimmer can ride the waterslide 101 and then stand up in the pool 153. A second spiral staircase 159 is provided in the middle of the pool 153 leading to a platform 161 to allow a rider to exit the waterslide 101.

A waterslide 201 according to yet another embodiment of the present invention is shown in FIGS. 7 to 10. The waterslide 201 corresponds in many ways to the waterslide 1 shown in FIGS. 1 to 4, and like reference numerals have been used for like components, albeit incremented by 200 for clarity.

Figure 8:
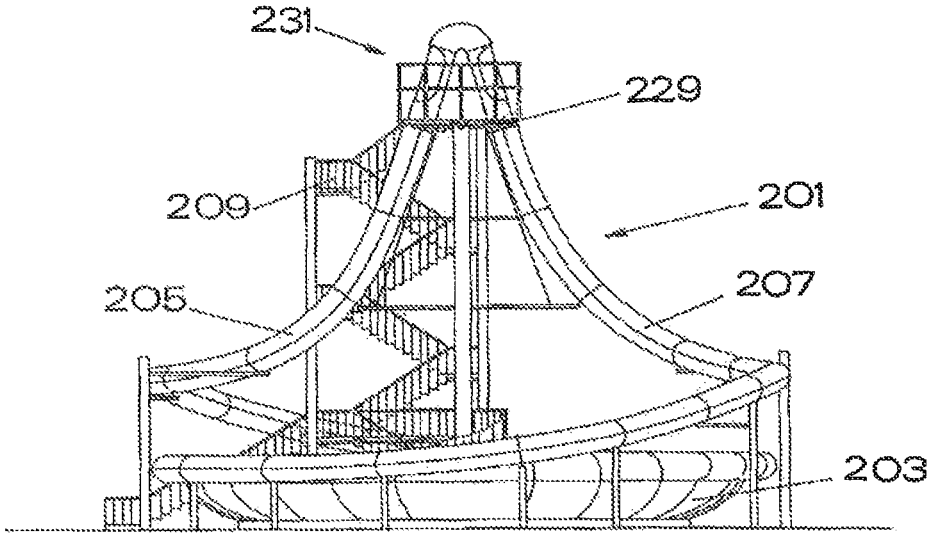
FIG. 8 shows a side elevation of the waterslide of FIG. 7.
Figure 9:
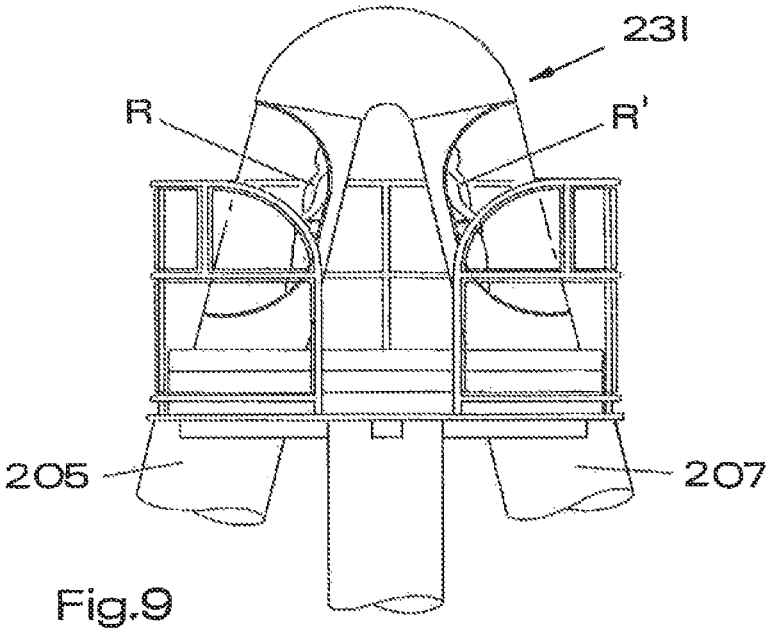
FIG. 9 shows an enlarged view of the launch station of the waterslide of FIG. 7.

The waterslide 201 comprises a bowl 203 into which riders R, R' are introduced. As shown most clearly in FIG. 7, the bowl 203 is circular and the two rider entrances 219, 221 are opposed from each other. The launch station 231 is provided on a gantry 229 accessed via a staircase 209, as shown in FIG. 8. The launch station 231 is adapted to launch two riders R, R' into the respective chutes 205, 207 at substantially the same time. An enlarged side view of the launch station 231 is shown in FIG. 9. Although the launch station 231 is shown with the riders R, R' standing back-to-back, it will be appreciated that they may face each other prior to launch.

Figure 10:
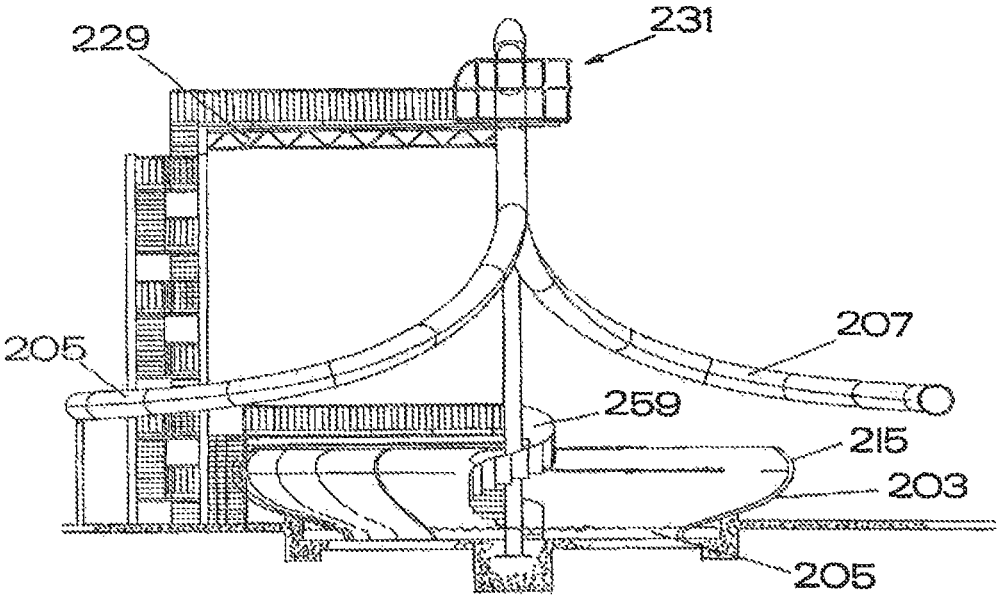
FIG. 10 shows a partial cutaway side elevation of the waterslide of FIG. 7.

As shown in the cutaway section of FIG. 10, the bowl 203 has a shallow pool 253 formed in the base thereof, similar to the arrangement in the waterslide 101. The riders R, R' may walk through the pool 253 to the centrally located spiral staircase 259.

As shown in FIG. 10, the chutes 205, 207 have a substantially circular cross-section, but it will be appreciated that different cross-sections, for example oval cross-sections, may also be appropriate. Moreover, the chutes 205, 207 may be open in sections or along a portion of their length. The bowl 203 has an inwardly directed rim 215, as shown in FIG. 10.

As will be appreciated by those skilled in the art, the waterslides and bowls described herein may be adapted to be ridden by a rider travelling on a craft, such as an inflatable inner ring or the like. Further, while embodiments have been described with particular reference to waterslides, it will be appreciated that the elements and features described herein may be applied to other leisure rides. For example, a rider may travel on a waxed fabric bag or a waxed fabric mat without the aid of flowing water. In addition, the bowl described herein may form only part of a larger system. For example, a rider may exit the bowl and enter another chute or slide.

Figure 11:
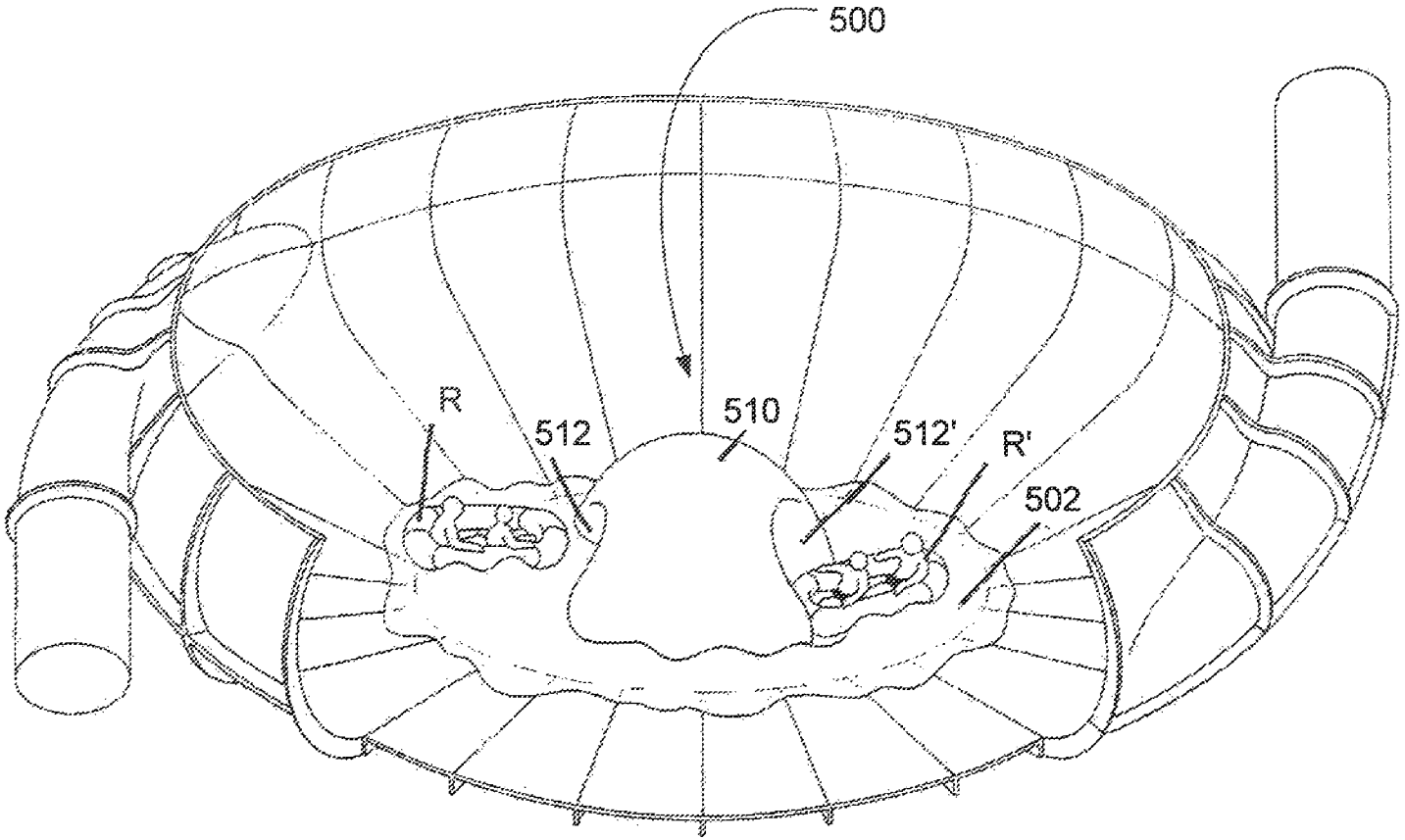
FIG. 11 shows an exit system according to an embodiment of the present invention.
Figure 12:
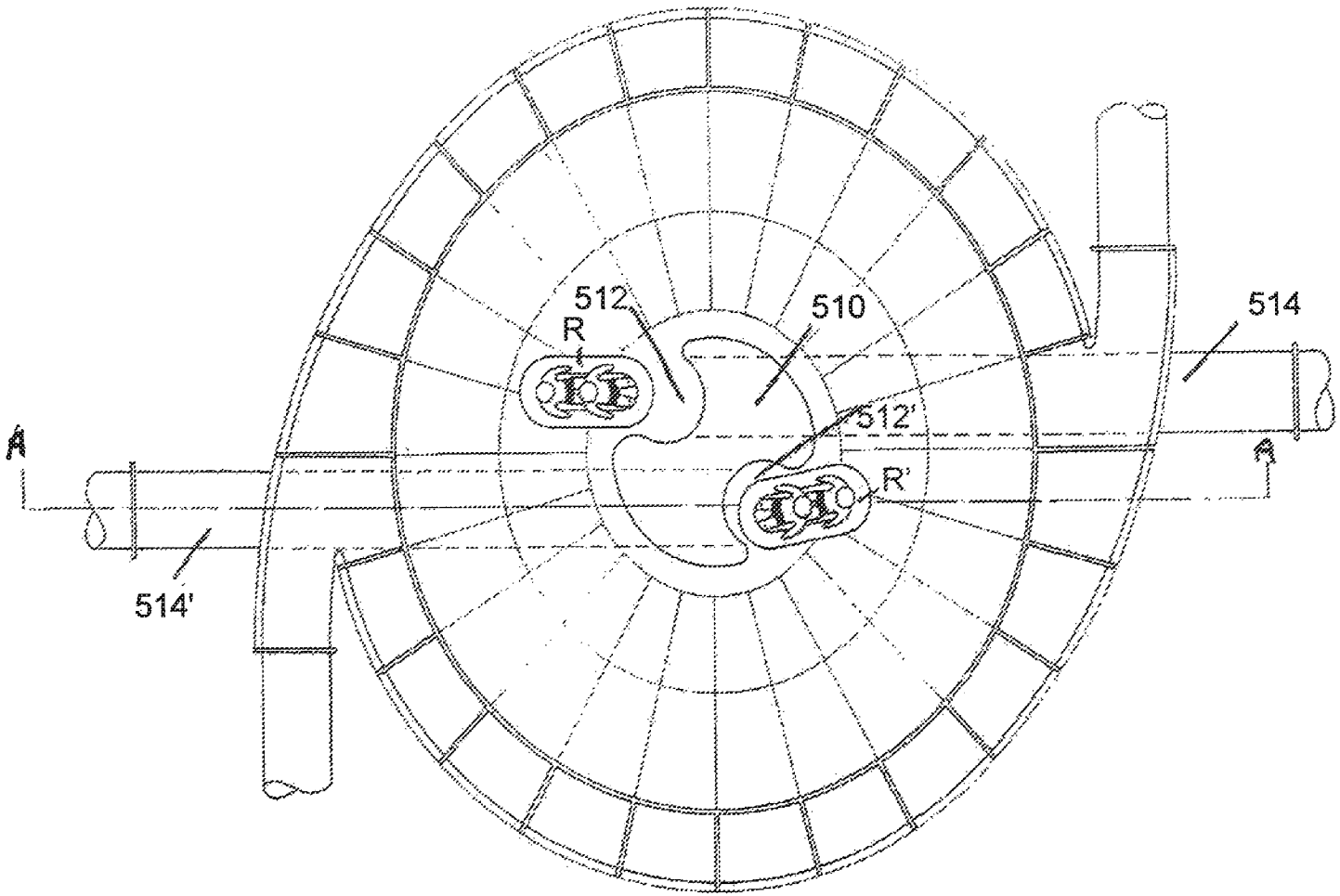
FIG. 12 shows a top view of the exit system of FIG. 11.
Figure 13:
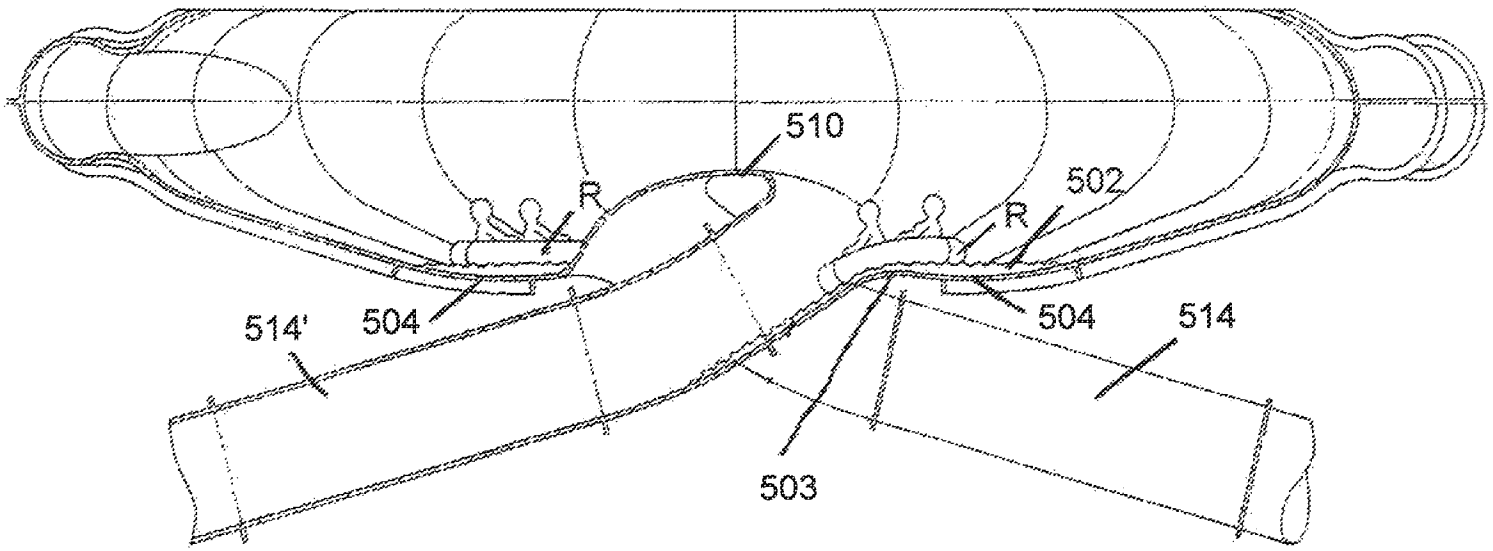
FIG. 13 shows a partial view taken from line A-A of FIG. 12.

FIGS. 11 through 13 show an exit system 500 that may be incorporated into a leisure slide, including those shown in FIGS. 1 through 10. For example, the system 500 may replace the aperture 17 and the pool 53 in the embodiment of FIGS. 1 through 4. The exit system 500 has a pool 502 at a base 504 of the bowl and a housing 510 with two exit ports 512, 512' at offset (e.g., generally opposed) angles. The pool 502 surrounds the housing 510 and is created by a shallow ridge 503 at the entrance to the ports 512, 512' that is higher than the base 504 of the bowl. The housing 510 is shown to be generally semi-spherical, though other shapes may alternately be used. It may be desirable for the angle between the exit ports 512, 512' to be generally equivalent to an angle between entrances (e.g., entrances 19, 21). The exit ports 512, 512' are sized to allow the riders R, R' to pass through, and lead to exit slides (or "chutes") 514, 514' designed to take the riders R, R' clear of the bowl or on to another part of the ride, aided by the flow of water from the pool 502. As the chutes 514, 514' may pass closely to one another, it may be desirable for the chutes 514, 514' to have side walls that prevent undesirable contact between the riders R, R'.

In use, the two exit ports 512, 512' may allow two riders R, R' to generally simultaneously exit the bowl while travelling in different (e.g., generally opposite) directions. As such, multiple riders may generally simultaneously enter the bowl while travelling in different directions, and may generally simultaneously exit the bowl while travelling in different directions. While at any given time the riders may travel in different directions, it should be appreciated that the riders may travel in a common overall direction (i.e., all of the riders may travel clockwise, or all of the riders may travel counter-clockwise). The ride may accordingly be safe for multiple users at one time, and may be cleared much quicker for use by subsequent users compared to rides with a single exit. While an arrangement for two riders R, R' is shown in FIGS. 11 through 13, those skilled in the art will appreciate that alterations may be made to accommodate additional riders in light of the teachings herein (e.g., an additional exit port and chute may be added for each additional rider). In addition, the exit system 500 may be constructed without the pool 502 for slides that do not include water.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims.

For the avoidance of any doubt, the contents of UK patent applications GB 0809011.0 (filed May 19, 2008) and GB 0815789.3 (filed Aug. 29, 2008)—both of which are incorporated by reference into PCT/GB2009/002286—are incorporated herein by reference.

The invention claimed is:

1. A waterslide apparatus comprising:

a bowl having a curved sidewall;

two or more rider entrances for enabling riders to slide into the bowl and to circuit at least a portion of the bowl, wherein said rider entrances are located substantially equidistant from each other around a circumference of the bowl; and a receptacle for forming a pool of water to receive a rider exiting the bowl;

wherein a nozzle is provided for directing a jet of water to bias a rider towards an edge of the pool.

2. The waterslide apparatus of claim 1, wherein the nozzle is adapted to direct the jet of water vertically upwards.

3. A slide apparatus, comprising a bowl having upper and lower ends and first and second entrances; the first and second entrances being distinct from one another and being spaced apart from the bowl lower end; the first and second entrances being configured to bias all users of the first and second entrances to travel about at least a portion of the bowl in a common direction, whether clockwise or counter-clockwise; a launch apparatus adjacent the first entrance and another launch apparatus adjacent the second entrance; each launch apparatus having a platform movable from a first position for supporting a user to a second position for releasing the user; each launch apparatus being under common control such that the platforms are movable from the first position to the second position substantially simultaneously.

4. The slide apparatus of claim 3, wherein the bowl has a third entrance distinct from the first and second entrances and being spaced apart from the bowl lower end; the third entrance being configured to bias all users of the third entrance to travel about at least a portion of the bowl in the common direction.

5. The slide apparatus of claim 3, including first and second exit slides respectively leading from the first and second exit ports.

6. A slide apparatus, comprising a bowl having upper and lower ends and first and second entrances; the first and second entrances being distinct from one another and being spaced wart from the bowl lower end; the first and second entrances being configured to bias all users of the first and second entrances to travel about at least a portion of the bowl in a common direction, whether clockwise or counter-clockwise, a pool of water at the bowl lower end, and one of:

(a) a nozzle configured to direct a jet of water to bias a user towards an edge of the pool; and (b) a housing with first and second exit ports respectively leading to first and second exit slides, the housing being surrounded by the pool of water, the first and second exit ports being positioned to receive users generally simultaneously.

7. The slide apparatus of claim 6, wherein the nozzle is adapted to direct the jet of water vertically upwards.

8. The slide apparatus of claim 6, wherein the first and second exit ports are generally opposed to one another.

9. The slide apparatus of claim 6, further comprising a launch apparatus adjacent the first entrance and another launch apparatus adjacent the second entrance; each launch apparatus having a platform movable from a first position for supporting a user to a second position for releasing the user; each launch apparatus being under common control such that the platforms are movable from the first position to the second position substantially simultaneously.

10. A slide apparatus, comprising a bowl having upper and lower ends and first and second entrances; the first and second entrances being distinct from one another and being spaced apart from the bowl lower end; the first and second entrances being configured to bias all users of the first and second entrances to travel about at least a portion of the bowl in a common direction, whether clockwise or counter-clockwise, and a housing at the bowl lower end with first and second exit ports respectively leading to first and second exit slides, the first and second exit ports being positioned to receive users generally simultaneously.

11. The slide apparatus of claim 10, wherein the first and second exit ports are generally opposed to one another.

12. The slide apparatus of claim 10, wherein:

the bowl has a third entrance distinct from the first and second entrances and being spaced apart from the bowl lower end; the third entrance being configured to bias all users of the third entrance to travel about at least a portion of the bowl in the common direction; and the housing has a third exit port leading to a third exit slide; the first, second, and third exit ports being positioned to receive users generally simultaneously.

13. A waterslide apparatus, comprising a bowl having upper and lower ends and first and second entrances; the first and second entrances being distinct from one another and being spaced apart from the bowl lower end; the first and second entrances being configured to bias all users of the first and second entrances to travel about at least a portion of the bowl in a common direction, whether clockwise or counter-clockwise, and a housing at the bowl lower end with first and second exit ports respectively leading to first and second exit slides, the first and second exit ports being positioned to respectively receive users who passed generally simultaneously through the first and second entrances.

14. The waterslide apparatus of claim 13, wherein said rider entrances are provided at substantially the same height.

15. The waterslide apparatus of claim 14, further comprising a plurality of chutes for conveying riders to said entrances.

16. The waterslide apparatus of claim 15, wherein the chutes each have an inlet, an outlet and a longitudinal axis, and wherein proximal the inlet the longitudinal axis of each chute is inclined at an angle of less than or equal to 30° measured relative to the vertical.

17. The waterslide apparatus of claim 16, further comprising a launch apparatus for launching the riders.

18. The waterslide apparatus of claim 17, wherein the launch apparatus is adapted to launch the riders into the bowl at substantially the same time.

19. The waterslide apparatus of claim 18, wherein the launch apparatus comprises at least one platform movable from a first position for supporting the rider to a second position for releasing the rider.

20. The waterslide apparatus of claim 18, wherein the launch apparatus comprises a plurality of movable platforms each suitable for supporting at least one rider.

21. The waterslide apparatus of claim 18, wherein the bowl has a generally circular, oval, or elliptical shape.

* * * * *